US010982825B2

(12) United States Patent
Haas et al.

(10) Patent No.: US 10,982,825 B2
(45) Date of Patent: Apr. 20, 2021

(54) ILLUMINATION SYSTEM AND METHOD

(71) Applicant: OSRAM GmbH, Munich (DE)

(72) Inventors: Norbert Haas, Langenau (DE); Norbert Magg, Berlin (DE)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 16/595,524

(22) Filed: Oct. 8, 2019

(65) Prior Publication Data

US 2020/0109826 A1 Apr. 9, 2020

(30) Foreign Application Priority Data

Oct. 8, 2018 (DE) ..... 10 2018 217 151.3

(51) Int. Cl.
*F21V 33/00* (2006.01)
*F21L 2/00* (2006.01)
*H05B 47/19* (2020.01)

(52) U.S. Cl.
CPC ..... *F21L 2/00* (2013.01); *H05B 47/19* (2020.01)

(58) Field of Classification Search
CPC ..... F21L 2/00; H05B 47/19; F21S 2/00
USPC ..... 362/184
See application file for complete search history.

(56) References Cited

U.S. PATENT DOCUMENTS 3,898,643 A * 8/1975 Ettlinger ..... G06F 3/033 700/84
2006/0049435 A1* 3/2006 Bill ..... H01L 27/10 257/278
2016/0353557 A1* 12/2016 Siegel ..... H05B 47/19
2017/0351946 A1* 12/2017 Jayawardena ..... G06K 19/0728

FOREIGN PATENT DOCUMENTS

DE 102014202445 A1 8/2015

OTHER PUBLICATIONS

German Search Report based on Application No. 10 2018 217 151.3, 8 pages, dated May 28, 2019 (for reference purpose only).

* cited by examiner

*Primary Examiner* — Ali Alavi
(74) *Attorney, Agent, or Firm* — Viering, Jentschura & Partner MBB

(57) ABSTRACT

Various embodiments provide an illumination system. The illumination system includes at least one effect lamp configured to emit radiation, a mobile lamp, which can be arranged on a mobile object and which is configured to emit radiation, and at least one control unit configured to control at least one of the effect lamp or the mobile lamp. The control unit is configured to control the effect lamp as a function of at least one of one or more state information items of the mobile lamp or of the effect lamp or of an object or in such a way that it controls the mobile lamp as a function of one or more state information items of at least one of the mobile lamp or of the effect lamp or of an object.

20 Claims, 2 Drawing Sheets

ILLUMINATION SYSTEM AND METHOD

CROSS-REFERENCE TO RELATED APPLICATION

This application claims priority to German Patent Application Serial No. 10 2018 217 151.3, which was filed Oct. 8, 2018, and is incorporated herein by reference in its entirety.

TECHNICAL FIELD

Various embodiments relate generally to an illumination system having at least one effect lamp, having at least one mobile lamp and at least one control unit. Various embodiments furthermore relate to a method for controlling the illumination system.

BACKGROUND

Effect lamps, for example moving heads, i.e. spot lamps with a moving head, or mobile or aimable follow spots, emit light spots, or directed light spots, which may be used in order to produce light effects, but also for controlled lighting of stage regions or for the illumination of an object. It is also possible that the effect lamp can follow the movement of an object and therefore illuminates the object. Fully automatic or semiautomatic following of objects is also possible, by optical and/or radio-controlled measuring systems, for example camera systems, light detection and ranging systems (LiDAR Systems) or radio systems. Furthermore, besides visible radiation, the effect lamps may also emit infrared and/or ultraviolet radiation. The objects on the stage may also include light-emitting lamps, for example luminous textiles. In the conventional effect lamps, the objects are often fitted with light-emitting diodes such as micro-LEDs, OLEDs and/or fluorescent and phosphorescent layers. Systems are furthermore known in which the light of one or more LEDs is input into an elongate fiber, reflected and scattered along a length extent of this fiber and then laterally output again so as to produce the impression of a self-illuminating fiber. It is furthermore possible to integrate self-illuminating fibers into textiles. For example, it is conceivable to weave organic light-emitting diode fibers (OLED fibers) into a textile.

SUMMARY

Various embodiments provide an illumination system. The illumination system includes at least one effect lamp configured to emit radiation, a mobile lamp, which can be arranged on a mobile object and which is configured to emit radiation, and at least one control unit configured to control at least one of the effect lamp or the mobile lamp. The control unit is configured to control the effect lamp as a function of at least one of one or more state information items of the mobile lamp or of the effect lamp or of an object or in such a way that it controls the mobile lamp as a function of one or more state information items of at least one of the mobile lamp or of the effect lamp or of an object.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
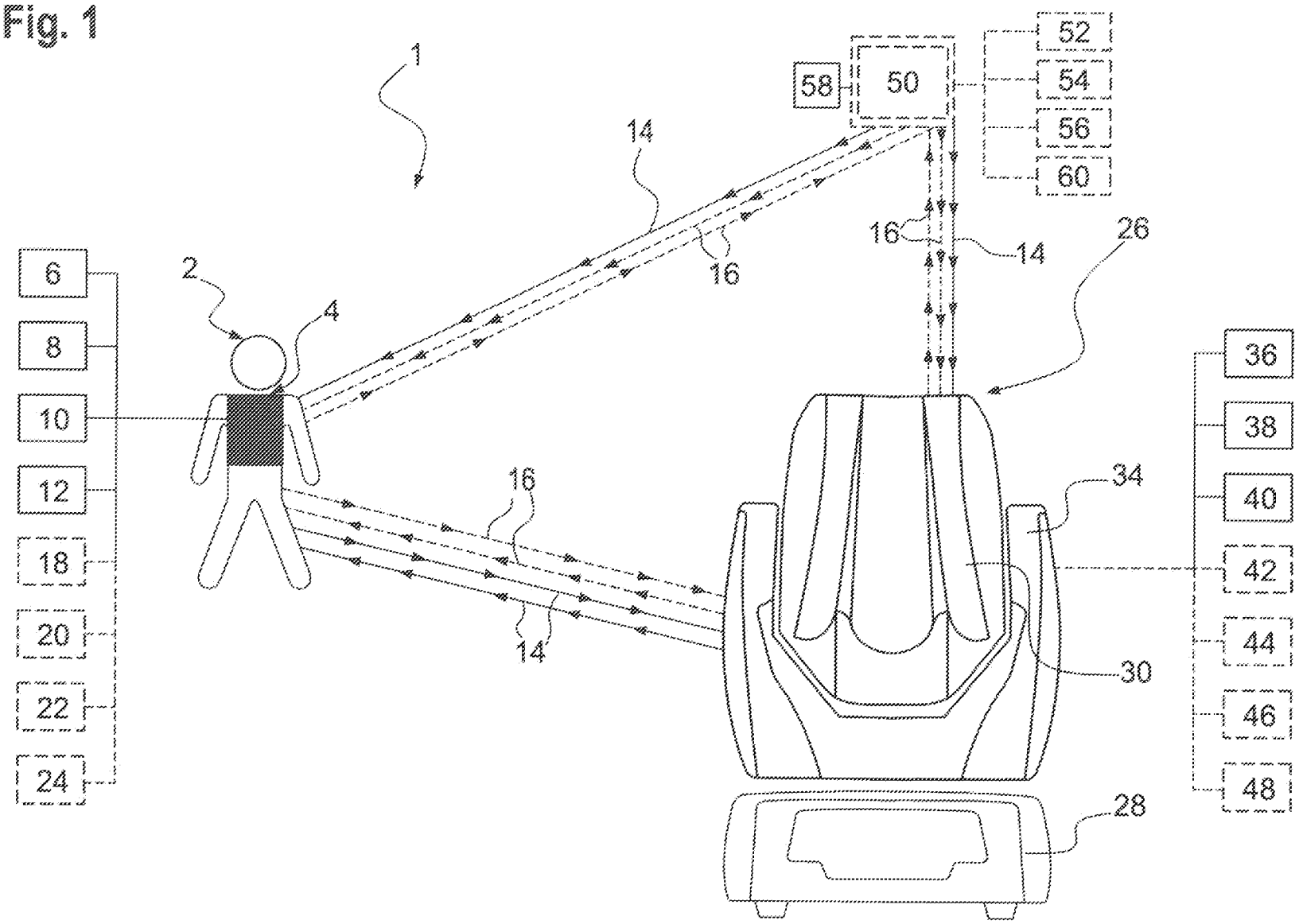
FIG. 1 shows an illumination system having a mobile lamp and an effect lamp according to various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide an illumination system having at least one effect lamp, having at least one mobile lamp and having at least one control unit. The effect lamp emits radiation, which can light a region in a controlled way. The mobile lamp may, for example, be arranged on an object that can be moved and/or is arranged in a mobile fashion. The control unit of the illumination system e.g. has the function of controlling the effect lamp as a function of at least one state information item of the mobile lamp. As an alternative or in addition, the control unit or a further control unit may be configured in order to control the mobile lamp as a function of at least one state information item of the effect lamp and/or as a function of at least one state information item of a further object and/or of the object on which the mobile lamp is arranged.

An effect of various embodiments is that the effect lamp can be controlled as a function of the mobile lamp, and for example a particular illumination effect, for example alternating flashing between the effect lamp and the mobile lamp, can therefore be generated. Furthermore, an effect of various embodiments is that the effect lamp may also interact with the mobile lamp in the case of an e.g. unpredicted event. For example, a performer who is, for example, carrying a mobile lamp, may on entrance improvise and, for example, perform an unplanned dance, and the effect lamp can nevertheless be linked to the mobile lamp and illuminate the performer. By various embodiments, it may furthermore be possible that the mobile lamp, e.g. in reverse, may also be controlled as a function of the effect lamp. In other words: the effect lamp and the mobile lamp are in, for example, continuous interaction with one another and are e.g. not only temporarily matched to one another. Furthermore, it may be provided that the mobile lamp can be controlled as a function of an object and/or of the object, on which it may be arranged. This has the effect that the mobile lamp may, for example, shine when it is in a particular spatial region. Furthermore, it may for example shine when the further object is in a particular spatial region, for example when a person who is not carrying the mobile lamp steps onto a stage region.

In various embodiments, the control unit is configured in such a way that the mobile lamp and the effect lamp can be controlled in correlation with one another. In other words, the effect lamp and the mobile lamp can be controlled in such a way that they are in, for example, constant interaction with one another. The control unit may control the effect lamp and/or the mobile lamp by control signals which are provided as a function of the state information. This may be provided since particular illumination effects can thus be generated, for example dynamic, alternating and/or uniform flashing of the mobile lamp and of the effect lamp. Nonuniform lighting is also possible, for example illumination for a piece of music, in which case the mobile lamp may for example emit light during a chorus and the effect lamp for example during a verse. By the correlation of the effect lamp and of the mobile lamp, it is in this case possible, for example, for only the effect lamp or only the mobile lamp to be controlled as a function of the piece of music, and for the respective other lamp, either the mobile lamp or the effect lamp, to be controlled by the control signal as a function of the state information of the other.

The illumination system e.g. includes a multiplicity of effect lamps and/or a multiplicity of mobile lamps. It is possible that some of the effect lamps, the effect lamp or all the effect lamps and/or some of the mobile lamps, the mobile lamp or all the mobile lamps can be controlled by the control unit. This may be provided since a flexible illumination system is therefore provided which may be adapted flexibly as required. It is, for example, possible that only some of the effect lamps and some of the mobile lamps are driven by the control unit in a first part of a concert, and all the effect lamps and all the mobile lamps in a second part of the concert. In a further configuration example, it is possible that the illumination system includes the effect lamp and a multiplicity of mobile lamps; a reverse arrangement with a plurality of effect lamps and the mobile lamp is also conceivable.

In various embodiments, there are various possibilities for arranging the control unit. If there is only one control unit or if only one control unit is provided for the control according to various embodiments, it is possible for the control unit to be arranged externally or on an or the effect lamp or on an or the mobile lamp. The examplary one control unit controls the effect lamp and/or the mobile lamp and/or at least some of the effect lamps and/or at least some of the mobile lamps by signals or control signals. It is, however, also possible for the illumination system to include more than one control unit. Respective control units may therefore, for example, be arranged on at least some of the effect lamps or on the effect lamp and/or at least on some of the mobile lamps or on the mobile lamp and/or externally. The illumination system may therefore be configured flexibly. If there is more than one control unit, it is for example possible that only the effect lamps or at least some of the effect lamps include a control unit and these are linked to the mobile lamps or at least some of the mobile lamps and control them. There is, however, also the possibility that, conversely, the control units are arranged only on the mobile lamps or at least some of the mobile lamps. It is, however, also possible that at least some of the mobile lamps and at least some of the effect lamps include a control unit. By the flexibility of the arrangement, it is possible to provide an illumination system which can be adapted to different requirements and possibilities of use.

In various embodiments, the illumination system includes one or more sensor unit(s), which can be arranged on the effect lamp or at least some of the effect lamps and/or on the mobile lamp and/or at least on some of the mobile lamps and/or on an object, and/or the illumination system includes at least one sensor unit which is externally arranged. The or one of the sensor unit(s) may for example be an optical system, such as a photoelectric barrier, and/or an acceleration sensor and/or a position determination sensor, for example a GPS sensor. The or one of the externally arranged sensor unit(s) may in this case, for example, record different state information items of, for example, the at least one object and/or the effect lamp or at least some of the effect lamps and/or the mobile lamp or at least some of the mobile lamps. The or one of the external sensor units may, for example, be the photoelectric barrier, which may record a winner in a race as state information. The or the respective sensor unit, which is arranged on the or the respective effect lamp or on the or the respective mobile lamp or on the object, may as an alternative or in addition determine the state information of that on which it is arranged, for example the position data of the respective component by the or the respective GPS sensor. By recording the state information of the effect lamp or at least some of the effect lamps and/or the mobile lamp or at least some of the mobile lamps and/or of the at least one object, it is possible to control the mobile lamp or at least some of the mobile lamps and/or the effect lamp or at least some of the effect lamps accordingly. For example, the object in the form of a ball may be recorded by the sensor unit during a football match and its precise position may thus be determined. With this state information of the ball, for example, shining of the mobile lamp or at least some of the mobile lamps and/or the effect lamp or at least some of the effect lamps may be initiated, for example when a goal is scored or for example also when the ball goes out of play. In other words, the mobile lamp or at least some of the mobile lamps and the effect lamp or at least some of the effect lamps may be controlled in such a way that the mobile lamp or at least some of the mobile lamps and/or the effect lamp or at least some of the effect lamps shine if an event that is detected by the sensor unit and/or one of the sensor units and/or the respective sensor unit occurs. An event may for example be a sporting event, for example a race to the finishing line, or for example an event may be an entrance, for example stepping on stage. In both cases, the event may be recorded as state information, for example by a photoelectric barrier.

In order to determine position data of the mobile lamp or at least some of the mobile lamp and/or the at least one object as state information, there are various possibilities. For example, it is possible to determine position data using a sensor unit arranged on the object, on which e.g. an or the mobile lamp is arranged. As an alternative or in addition to the GPS sensor, the sensor unit may for example be a smartwatch and/or a smart wristband and/or a smart phone. The position data may be recorded in an X-Y-Z coordinate system in order to make accurate determination of the position data possible. For example, the position data of an acrobat who moves in all spatial directions, i.e. in an X-Y-Z coordinate system, may therefore be determined accurately. Furthermore, the position data of the or some of the mobile lamp(s) and/or of the at least one object may be recorded by a camera system, i.e. by an optical position detection system, for example a light detection and ranging system (LiDAR Systems). The camera system may, for example, be arranged statically. The data recorded by the camera system may be evaluated by an evaluation unit and/or object recognition and/or object classification. The optical systems may for example identify persons and groups of persons, e.g. summarize groups of persons, for example a dance team or a figure skating pair. The evaluation unit and/or an evaluation system may furthermore evaluate a facial expression of a person and use this as state information. For example, a performance of a stage play may thus be fully improvised, and the illumination system may for example react to an angry facial expression, for example, by the effect lamp emitting red light. If the or the respective mobile lamp which the person with the angry facial expression is carrying is correlated with the effect lamp which emits red light, it may likewise give out red light.

The position data of the effect lamp may also be recorded as state information items. The position data of the effect lamp or at least some of the effect lamps, which may be recorded as state information, may for example be the radiation direction of the emitted radiation of the effect lamp. In other words, the tilting position and/or the tilting angle of a tiltable head, for example a moving head, of the effect lamp may for example be recorded as state information. If the effect lamp or at least some of the effect lamps are arranged linearly movably, e.g. on a rail, the position of the or at least some of the effect lamp(s), for example on the rail, may also be recorded as position data.

As an alternative or in addition, the state information may be an operating state of a controllable light source of the mobile lamp or at least some of the mobile lamps and/or the effect lamp or at least some of the effect lamps. The operating state of the light source of the mobile lamp and/or the effect lamp, which is recorded as state information, is for example the flashing frequency and/or the color of the controllable light source and/or, in the case of an effect lamp, for example a pattern which the effect lamp may generate, for example using a filter and/or a mask. By accurate recording of state information items of at least some of the mobile lamps and/or the mobile lamp and/or at least some of the effect lamps and/or the effect lamp, it is possible to establish a correlation and/or interaction between the lamps in a straightforward way. For example, it is possible for the or one of the mobile lamp(s) to shine red and for this to be forwarded as state information to the or the respective control unit, and for the latter to emit a control signal as a function of this state information so that an or at least some of the effect lamp(s) shine green.

In various embodiments, the sensor unit or at least some of the sensor units and/or the effect lamp or at least some of the effect lamps and/or the mobile lamp or at least some of the mobile lamps includes an or a respective communication unit, which communicates by at least one signal and/or is connected to the communication unit. The signal may, for example, be a control signal and/or state information. As an alternative or in addition, the control unit or at least some of the control units may likewise include a communication unit and/or be connected thereto. By the communication units, the components of the illumination system may communicate with one another and exchange state information items and/or control signals. The signals, e.g. the state information items and/or the control signals, may be transmitted between the communication units by means of ultraviolet light and/or infrared light and/or by means of visible light radiation, i.e. encoding of the light radiation in the sense of visible light communication (VLC), and/or by means of radio and/or by means of ultrasound. Using the communication unit, it may be possible, for example, for a sensor unit which is a GPS sensor to send the position data of an object as state information using the communication unit, for example to an or the control unit(s), which likewise includes a communication unit, and for the control unit to send a control signal using the communication unit to the communication unit of this or at least some of the effect lamp(s) as a function of this state information, and to orientate the or at least some of the effect lamps as a function of this control signal, for example, in such a way that they illuminate the object.

Furthermore, it may be provided for the communication unit to emit an encoded signal, which is encoded in an individualized fashion and therefore is uniquely assignable to a component. In other words, the state information items may be encoded in such a way that the state information items can be assigned to the or the respective effect lamp or the or the respective mobile lamp of the at least one object. For example, confusion may thus be prevented. By the encoding, it is for example possible that state information items which are sent by two different communication units, and which may for example be the position data of a singer and a guitarist on a stage, can be uniquely identified and, for example, the guitarist is lit in blue by at least one or the effect lamp and the singer is lit in red by at least one or the effect lamp. In other words, it is possible to prevent the position data of the singer and guitarist from being confused.

The control signals may likewise be encoded, so that only intended effect lamps or the effect lamp and/or the mobile lamp or intended mobile lamps are controlled by the control signals. In various embodiments, the components to be controlled are also encoded so that they can be identified. This encoding may for example be carried out at the beginning of a show, e.g. at the entrance of a guest and/or when handing out a light-emitting textile which contains at least one mobile lamp and is given to the performers at the start of the show. In other words, the or at least some of the effect lamp(s) and/or the or at least some of the mobile lamp(s) may also be controlled in an individualized fashion. It is for example possible that for example in the case of a concert, the encodings may be matched with the seats to be occupied and, for example, position-dependent effects are thus achieved. By seat-dependent encoding, for example, shining of the mobile lamps may be controlled in a particular order so that a light effect is created, for example in a similar way to a Mexican wave, since the mobile lamps can be driven individually. If, for example, there are three mobile lamps in this exemplary embodiment, they may be encoded in such a way that for example, three seats 1, 2 and 3 are assigned. One of the or the control units may therefore send a control signal which, for example, controls only the mobile lamp at seat 1. If the position of the or of the respective mobile lamps is determined, it is possible to achieve this effect even without seat-dependent encoding, by determining the precise positions of the or the respective mobile lamps. Thus, for example, the position data of the mobile lamps may be known, and by the encoding it is possible to identify the left mobile lamp and let this shine as a function of its position, i.e. position-dependently. Furthermore, it is also possible to activate the mobile lamps according to how great the density of mobile lamps at a particular position is. In other words, if a group of a multiplicity of mobile lamps is for example formed, the members of the group of mobile lamps may be identified by the encoded state information and they may be controlled in a targeted way by the encoded control signal. As an alternative or in addition, with a known or even with an unknown position determination of mobile lamps, it is also possible to drive them by means of a stochastic algorithm.

In various embodiments, the effect lamp and/or at least some of the effect lamps are configured so that the radiation direction of the emitted radiation is adjustable. In other words, pan and/or tilt and/or yaw, that is to say the rotation and/or the inclination and/or the yaw angle, of the effect lamp or at least some of the effect lamps may be adjustable. As an alternative or in addition, the effect lamp and/or at least some of the effect lamps are arranged movably on a rail. The or the respective effect lamp may in this case, for example, be tilted and/or moved on the rail by at least one servomotor, which is for example controlled by a control signal. By these features of the effect lamp and/or at least some of the effect lamps, it is possible that a large region may be lit by an effect lamp, and that the latter may for example follow a mobile object and/or a person over a large region of the stage, or may shine on it, while being controlled by a control signal which is generated as a function of state information, in this case the position data.

Furthermore, the or the respective effect lamp includes at least one controllable light source. In various embodiments, the or the respective effect lamp includes different light sources, which emit light with different colors. Furthermore, it is possible for the or the respective effect lamp to include a system with optical elements, which are configured in order to concentrate and/or spread the light emitted by the light source(s). This may be provided since the or at least some of the effect lamp(s) may therefore generate different light effects in a straightforward way. Furthermore, the effect lamp e.g. includes a lighting means controller and a lighting means driver. These may, for example, be part of the control unit or of the respective control unit. The lighting means controller, which is for example an application-specific integrated circuit, may convert the control signals, which have e.g. been received by the communication unit, into instructions for the lighting means driver and the lighting means driver switches the effect lamp as a function of the instructions, so that, for example, they emit the light color corresponding to the control signal. For example, a communication unit of a control unit emits a control signal as a function of state information, for example of the mobile lamp or of some of the mobile lamps. This control signal may be received by the communication unit which is arranged on the effect lamp. The control signal is subsequently forwarded to the lighting means controller and then to the lighting means driver, which switches the effect lamp. It is, however, also possible for one of the or the control unit(s) to be arranged on the effect lamp and for the lighting means controller and the lighting means driver to be a part thereof. In this case, the control unit may directly control the effect lamp on which it is arranged, by its transmitting control signals to the lighting means controller by a direct connection, for example by a cable. It may furthermore be advantageous for the effect lamp to include an energy store in order to supply the effect lamp with energy. This may have the effect that the effect lamp may therefore be arranged independently of a power supply system and, for example, not have a trailing cable to a plug.

The effect lamp may furthermore include a data memory, on which for example a program for controlling the settings of the effect lamp(s), e.g. the radiation directions of the emitted light of the effect lamp(s) and/or of the light colors to be emitted of the light source(s) and/or the flashing effects of the light source(s) is/are stored. This program may be initiated by a state information item. In the case of a football match, for example, a goal may be scored and the effect lamp or at least some of the effect lamps may emit their light in different directions in a sequence scored on the data memory and/or may emit a sequence of flashing and/or color effects. For example, it is stored in the program that the effect lamp or the respective effect lamp radiates the light emitted by the light source in rapid alternation upward and downward, and that it alternately emits, for example, red and blue light. This program may for example be stopped by state information, in this exemplary embodiment for example a whistle, and/or may also be temporally limited.

Furthermore, the control unit or the respective control unit of the or the respective effect lamp and/or of the data memory or of the respective data memory of the or the respective effect lamp may e.g. include a program which, from the state information items of the effect lamp, e.g. determined by the or the respective sensor unit, calculates and/or graphically represents the beam trajectories, for example on a monitor. This calculation may take place in the millisecond range. For the or the respective effect lamp, e.g. at each instant, it is therefore possible to calculate which spatial regions are lit. Furthermore, a light parameter may for example be known, which may e.g. be a color and/or an intensity and/or a pulse mode of the or the respective effect lamp. By recording these parameters, particularly accurate control of the effect lamp or at least some of the effect lamps may be achieved.

In various embodiments, the or the respective mobile lamp includes at least one controllable light source, e.g. different controllable light sources with different colors. As an alternative or in addition, an energy store and/or a data memory may be arranged on the or the respective mobile lamp. Furthermore, the or the respective mobile lamp may include a lighting means controller and/or a lighting means driver, which may be part of an or the control unit. The lighting means controller and/or lighting means driver may be arranged separately on the object, for example on the body of a person and/or integrated in the or the respective mobile lamp, for example in a housing or even arranged on the or the respective mobile lamp. The light source(s) of the or the respective mobile lamp may be controlled in different ways. For example, the color and/or the intensity and/or the duration of a light effect may be modified. Furthermore, e.g. by control signals which are sent as a function of state information items and have been received by the respective communication unit of the or the respective mobile lamp, preprogrammed programs stored in the data memory of the or the respective mobile lamp may be activated.

The mobile lamp may be arranged on a wide variety of objects in the illumination system. These include for example persons, such as players and/or actors and/or singers and/or musicians, a textile into which the mobile lamp and/or a plurality of mobile lamps may be integrated, and/or for example an inanimate object such as a vehicle and/or stage equipment and/or a drone. It is also possible to arrange a multiplicity of mobile lamps on an object. By the possibility of fitting the or the respective mobile lamp flexibly, it is possible to generate many different light effects, also in combination with the or at least some of the effect lamps, and to use the illumination system flexibly.

The data memory, which the or the respective effect lamp and/or the or the respective mobile lamp includes, may also include correlated programs, so that the light effects of the or at least some of the effect lamp(s) and the or at least some of the mobile lamp(s) are correlated. During a piece of music, for example, different settings of the or at least some of the mobile lamp(s) and/or the effect lamp or at least some of the effect lamps may be stored on the data memory, and these may be activated by the start of the piece of music.

There are different possibilities as to how the effect lamp or at least some of the effect lamps and/or the mobile lamp and/or at least some of the mobile lamps are correlated with one another. For example, the effect lamp or at least some of the effect lamps and/or the mobile lamp and/or at least some of the mobile lamps may exhibit a flashing behavior adapted to one another. For example, they may flash synchronously, e.g. with the same frequency and phase angle, and/or asynchronously, e.g. with the same frequency but an offset phase angle, e.g. precisely in antiphase and/or with different frequencies, e.g. slightly different frequencies, in order to produce a kind of floating effect.

Furthermore, the effect lamp or at least some of the effect lamps and/or the mobile lamp and/or at least some of the mobile lamps may exhibit a color reproduction behavior adapted to one another and, for example, shine in the same colors or in complementary colors. In addition, a flashing effect may be superimposed and an abrupt or continuous color change may be provided.

In addition, the effect lamp or at least some of the effect lamps and/or the mobile lamp and/or at least some of the mobile lamps may exhibit a brightness behavior adapted to one another. In this case, for example, in-phase or antiphase brightness settings may be provided. In addition, flashing and/or color effects may be superimposed.

It is furthermore possible for the effect lamp or at least some of the effect lamps and/or the mobile lamp and/or at least some of the mobile lamps to be mutually adapted to one another only partially. For example, individual groups may be formed, for example from the effect lamp or at least some of the effect lamps together with the mobile lamp or at least some of the mobile lamp. Different groups may in this case differ in their behavior, e.g. the flashing and/or color and/or brightness settings mentioned above. Individual groups may in this case exhibit the same or different flashing behavior, i.e. they may be driven in-phase or in antiphase or in a different phase relation to one another.

As an alternative or in addition, all the effects may also be dependent on the position data of the mobile lamp or at least some of the mobile lamps or on the mobile lamp. For example, mobile lamps which for example are arranged on different persons who move from the left side of the stage to the right side of the stage may be modified in terms of their light color to be emitted and, for example, the mobile lamps on one side of the stage may shine green and gradually change color to red while the position data of the mobile lamps, which are used as state information items, are recorded and the emitted color is controlled by the or the respective control unit as a function of the position data. The same may apply for all other effects mentioned above, including in combination. Furthermore, the effect lamp or at least some of the effect lamps may be adapted synchronously for this effect. This means that the effect lamps may light the persons who are carrying the mobile lamps, for example with the same colors as the mobile lamps include, and therefore change their emitted color as a function of the emitted color of the mobile lamps, which may be a state information item of the mobile lamps.

Furthermore, two mobile lamps may also be correlated with one another. For example, the brightness of the mobile lamps may change when they approach one another or move further apart. In this case as well, the position data are used as state information items, as a function of which the mobile lamps are controlled.

As an alternative or in addition, it is possible to drive the or at least some of the effect lamp(s) or the or at least some of the mobile lamp(s) manually. To this end, for example, a control console or an input device may be used. In other words, it is possible for the or at least some of the effect lamp(s) or the or at least some of the mobile lamp(s) to be controlled as a function of an externally entered control signal.

In addition to the mobile lamps, the object on which the mobile lamp is fastened may include fluorescent and/or phosphorescent objects, for example fluorescent or phosphorescent fibers, which luminesce under suitable irradiation. Further illumination effects may therefore be achieved in a straightforward way.

The method for controlling at least the mobile lamp or some of the mobile lamps and/or at least the effect lamp or some of the effect lamps includes the following steps: in a first step, the operating state of the effect lamp and/or at least some of the effect lamps and/or an operating state of the mobile lamps and/or at least some of the mobile lamps may be recorded by the or the respective or some of the sensor unit(s). As an alternative or in addition, the state, which is defined beforehand, of an object may be recorded. The respective state is recorded as a respective state information item and may be forwarded to a or a respective control unit. The forwarding may either be carried out using a fixed connection between the control unit and the sensor unit, for example a cable. This, for example, is possible when the control unit is arranged on the sensor unit. As an alternative or in addition, the state information may be transmitted wirelessly by communication units between the sensor unit and the control unit. In the second step, by a communication unit of the control unit, which is arranged on the respective mobile lamp and/or the respective effect lamp, and/or by a communication unit of an external unit which includes a control unit, a control signal may be generated as a function of the recorded state information item and/or the control signal may be generated manually. In other words, the control unit may generate the control signal as a function of the state information item recorded by the or the respective or some of the sensor unit(s), which have been forwarded to the control unit, and send the control signal by means of the communication unit. In the third step, the control signal may be received by a respective communication unit, which is respectively arranged on the mobile lamp or at least some of the mobile lamps and/or the effect lamp or some of the effect lamps. If the control unit is arranged on the component to be controlled, the control signal may also be transmitted by means of a fixed connection, for example a cable. In the fourth step, the operating state of the mobile lamp or some of the mobile lamps and/or the effect lamp or some of the effect lamps may be modified as a function of the control signal which has been generated by the control unit as a function of the state information item. The received control signal is forwarded from the respective communication unit or directly from the control unit to the respective lighting means controller, which converts the control signal into an instruction and then forwards it to the lighting means driver, which switches the or the respective effect lamp or the or the respective mobile lamp so that they are switched according to the control signal.

The method may, for example, be carried out in such a way that a football goal or a key scene in a play or a position of a particular person, who is carrying at least the mobile lamp, may be state information and may be recorded by a respective or the or at least some of the sensor unit(s). The state information may subsequently be forwarded by the communication unit of the sensor unit or of the respective sensor unit or of some of the sensor units to the control unit or the respective control unit, and/or the sensor unit is connected to the control unit. In this case, the control unit may be arranged on the or the respective effect lamp or the or the respective mobile lamp or externally. The control unit, which has obtained the state information item from the sensor unit, may subsequently generate a control signal which is dependent on the state information item. For example, a control signal can be generated by the control unit as a function of the state information item, which control signal initiates red flashing of all the effect lamps that receive this control signal by means of the respective communication unit of the respective effect lamp. It is also possible, for example, to initiate a red flashing signal at the same frequency in at least some of the mobile lamps. To this end, the control signal is encoded in such a way that all the ones that receive the control signal are controlled by the control signal. In various embodiments, for example, it is possible for the position of a particular person to be forwarded as state information to the or the respective control unit, so that the control signal that is generated and sent controls the effect lamp or at least some of the effect lamps in such a way that the effect lamp(s) light this person.

FIG. 1 represents an illumination system 1, which includes a person 2 as an object on which a mobile lamp 4, which is a luminous textile, is arranged. The mobile lamp 4 includes an energy store 6 in order to supply the mobile lamp 4 with energy. The mobile lamp 4 furthermore includes a lighting means controller 8 and a lighting means driver 10, which switches or controls a light source 12 of the mobile lamp 4. In order to receive and/or send signals, for example control signals 14 and/or state information items 16, the mobile lamp 4 furthermore includes a communication unit 18. In addition, the mobile lamp 4 may also include a sensor unit 20, which for example records an operating state of the mobile lamp 4 and/or of an effect lamp (which is explained below), and/or a control unit 22 which can generate control signals 14 from state information items 16. As an alternative or in addition, a data memory 24 may be provided, which for example stores programs, for example flashing sequences of the at least one light source 12.

An effect lamp 26 is furthermore part of the illumination system 1. This lamp has a base 28 and a tiltable head 30, or moving head, in which at least one light source (which is not represented here) is arranged, and which is enclosed in a fork fashion by a rotatable arm 34. The rotatable arm 34 is arranged on the base 28. The effect lamp 26 furthermore includes a servomotor 36, which can move the tiltable head 30. In order to receive and send signals, the effect lamp 26, in a similar way to the mobile lamp 4, includes a communication unit 38. The effect lamp 26 furthermore includes a lighting means controller 40 and a lighting means driver 42, which control and switch the light source of the effect lamp 26. It is furthermore possible for the effect lamp 26 to include a sensor unit 44 and/or a data memory 46. The sensor unit 44 may, for example, record the operating state of the mobile lamp 4 and/or of the effect lamp 26. The effect lamp 26 may furthermore, like the mobile lamp 4, include a control unit 48.

The illumination system 1 may furthermore include at least one external unit 50, which may contain a control unit 52 and/or an external sensor unit 54 and/or an external data memory 56. For communication with the effect lamp 26 and/or the mobile lamp 4, the external unit 50 includes a communication unit 58. It is furthermore possible for the external unit 50 to include an input device 60. This may be used for manual input of control signals.

The communication units 18, 38 and 58, the mobile lamp 4, the effect lamp 26 and the external unit 50 may communicate with one another with signals. Dashed lines represent state information items 16, and solid lines represent control signals 14. The arrows illustrate the direction from which the signals are sent. State information items 16 may be sent and received by the effect lamp 26 and by the mobile lamp 4 and also the external unit 50. The individual components effect lamp 26, mobile lamp 4 and external unit 50 e.g. send only state information items 16 if they include a sensor unit 20, 44, 54 or are connected to a sensor unit 20, 44, 54. Control signals 14 may also be sent by all the components 4, 26 and 50 if they include a control unit 22, 48, 52 or are connected to a control unit 22, 48, 52. The control signals 14 are, for example, received by the effect lamp 26 and the mobile lamp 4. The lighting means driver 10, 42 and the lighting means controller 8, 40 control the light source 12 of the mobile lamp 4 or the light source of the effect lamp 26 according to the control signal 14. If the effect lamp 26 receives a control signal 14, the servomotor 36 may correspondingly control the tiltable head 30 and the rotatable arm 34, and also shines the light source of the effect lamp 26 according to the control signal 14.

By this structure, it is possible for the effect lamp 26 and the mobile lamp 4 to be correlated with one another, or to be in interaction with one another. For example, the mobile lamp 4 sends out the state information item 16, which for example is red shining of the light source 12 of the mobile lamp 4 and is recorded by the sensor unit 20 of the mobile lamp 4, using the communication unit 18. The communication unit 58 of the unit 50 receives the state information item and, as a function thereof, generates a control signal 14 which, for example, is intended to generate blue shining of the light source of the effect lamp 26. The control signal 14 is then sent out by the communication unit 58 of the unit 50 and received by the communication unit 38 of the effect lamp 26. The communication unit 38 forwards the control signal 14 to the lighting means controller 40. The latter generates an instruction and forwards this to the lighting means driver 42, which switches the light source of the effect lamp 26 to blue. Generation of a control signal 14 by the control unit 22 of the mobile lamp 4 is also possible in this example, so that the control unit 22 sends out a control signal 14 using the communication unit 18, which contains the instruction to switch the light source of the effect lamp 26 to blue.

By the input device 60 of the external unit 40, it is furthermore possible, for example, that manual intervention is also carried out in the control.

Figure 2:
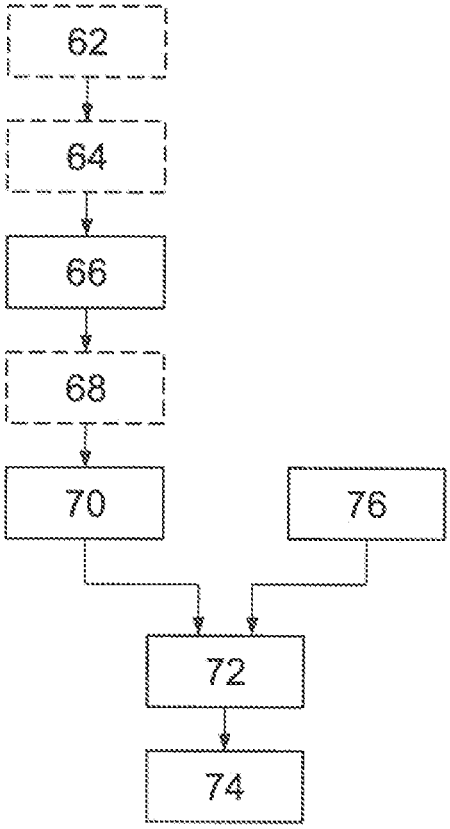
FIG. 2 shows a flowchart of a method according to various embodiments.

FIG. 2 is a flowchart of a method which, according to various embodiments, may optionally start with step 62. In step 62, the operating state of the effect lamp 62 or at least some of the effect lamps, if the illumination system 1 includes a multiplicity of effect lamps, is determined. In the optional next step 64, the operating state of the mobile lamp 4 or of some of the mobile lamps, if the illumination system 1 includes a multiplicity of mobile lamps, is determined. In step 66, an event is recorded as a state information item 16. This may, for example, be carried out by a sensor unit 20, 44, 54. The recorded event may, for example, be a goal in a football match, or the mobile lamp 4 or at least some of the mobile lamps may be at a particular position. Step 68 is optional. In this step 68, the state information item 16 can be forwarded by a communication unit 18, 38, 58, for example to a communication unit 58 which is arranged on an external control unit 52 or is connected thereto. In step 70, a control signal 14 is generated by the control unit 22, 48, 54 according to the state information item 16, and sent by the communication unit 18, 38, 58 which is arranged on this control unit 22, 48, 54 or is connected thereto. This control signal 14 is received in step 72 by a respective communication unit 18, 38 of the mobile lamp 4 or at least some of the mobile lamps and/or the effect lamp 4 and/or at least some of the effect lamps. In step 74, the components 4, 26 that have received the control signal 14 are controlled according to the control signal 14 by the control signal 14 being forwarded from the communication unit 18, 38, 58 to the lighting means controller 8, 40 and then to the lighting means driver 10, 42.

As an alternative or in addition to steps 62 to 70, it is also conceivable for a step 76 to be carried out. In this step 76, a control signal 14 is sent according to a manual input by a user on the input device 60.

Various embodiments disclose an illumination system having at least one effect lamp and at least one mobile lamp and a control unit. The mobile lamp may be arranged on a mobile object and, like the effect lamp, may emit radiation. The control unit is configured in such a way that the mobile lamp and/or the effect lamp are mutually correlated. This means that the effect lamp is controlled as a function of one or more state information items of the mobile lamp and/or the mobile lamp is controlled as a function of one or more state information items of the effect lamp and/or of an object.

Various embodiments provide an illumination system which is improved in a simple and economical way. Furthermore, various embodiments provide a simple method for controlling the illumination system.

LIST OF REFERENCE SIGNS

Illumination system 1
Person 2
Mobile lamp 4
Energy store 6
Lighting means controller 8, 40
Lighting means driver 10, 42
Light source 12
Control signal 14
State information item 16
Communication unit 18, 38, 58
Sensor unit 20, 44, 54
Control unit 22, 48, 52
Data memory 24, 46, 56
Effect lamp 26
Base 28
Tillable head 30
Rotatable arm 34
Servomotor 36
External unit 50
Input device 60

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An illumination system, comprising:
at least one effect lamp configured to emit radiation;
at least one mobile lamp arranged on a mobile object; wherein
the mobile lamp comprises at least one controllable light source configured to emit radiation; and
at least one control unit configured to control at least the mobile lamp and optionally the at least one effect lamp based on one or more state information items of the at least one mobile lamp, the at least one effect lamp, an object, or combinations thereof.

2. The illumination system of claim 1,
wherein the control unit is configured to control the mobile lamps and/or the in such a way that the one or more mobile lamps and the one or more effect lamps are mutually correlated.

3. The illumination system of claim 1,
wherein the at least one effect lamp comprises a plurality of effect lamps, the at least one mobile lamp comprises a multiplicity of mobile lamps, or combinations thereof.

4. The illumination system of claim 1,
wherein the at least one effect lamp comprises the control unit, or wherein the at least one mobile lamp comprises the control unit.

5. The illumination system of claim 1,
wherein the control unit is assigned to the one or more effect lamps or the at least one mobile lamp.

6. The illumination system of claim 1,
wherein the at least one effect lamp, the at least one mobile lamp, an object, or combinations thereof comprises a sensor unit configured to record a respective operating state of the at least one effect lamp, the at least one mobile lamp, the object, combinations thereof.

7. The illumination system of claim 1,
wherein the one or more state information items comprises at least one of the position of the at least one effect lamp, the at least one mobile lamp, or combinations thereof; an operating state of a controllable light source of the at least one effect lamp, the at least one mobile lamp, or combinations thereof.

8. The illumination system of claim 1,
wherein the at least one effect lamp is tiltable in at least some of the spatial directions or arranged movably.

9. The illumination system of claim 1,
wherein the at least one effect lamp comprises at least one controllable light source, a data memory, or combinations thereof.

10. The illumination system of claim 1,
wherein the at least one mobile lamp further comprises an energy store, a data memory, or combinations thereof.

11. The illumination system of claim 6,
wherein the control unit, sensor unit, or combinations thereof comprises a communication unit.

12. The illumination system of claim 11,
wherein the communication unit is configured to transmit the state information items of the at least one effect lamp, the at least one mobile lamp, an object, or combinations thereof.

13. The illumination system of claim 9,
wherein the data memory contains at least one sequence of state information items of the at least one effect lamp, the at least one mobile lamp, or combinations thereof.

14. The illumination system of claim 5,
wherein the control unit is configured to control an operating state of the at least one effect lamp, the at least one mobile lamp, or combinations thereof.

15. The illumination system of claim 14,
wherein the control unit is configured to activate or deactivate the operating state.

16. The illumination system of claim 1,
wherein the object is at least one of a person, a textile, a living being, or an inanimate object.

17. The illumination system of claim 11,
wherein the communication unit is configured to communicate wirelessly.

18. A method for controlling an illumination system, the illumination system comprising:

at least one effect lamp configured to emit radiation;

at least one mobile lamp arranged on a mobile object;

wherein the mobile lamp comprises at least one controllable light source configured to emit radiation; and at least one control unit configured to control at least the mobile lamp and optionally the at least one effect lamp based on one or more state information items of the at least one mobile lamp, the at least one effect lamp, an object, or combinations thereof;

the method comprising:

recording at least one of an operating state of the at least one effect lamp, the at least one mobile lamp, an object, or combinations thereof based on state information obtained from a sensor unit;

sending a control signal based on the state information items by the communication unit of the at least one mobile lamp, the at least one effect lamp, an external unit, a function of manual input, or combinations thereof;

receiving the control signal by a communication unit of the at least one mobile lamp, the at least one effect lamp, or combinations thereof; and changing the operating state of the at least one mobile lamp, the at least one effect lamp, or combinations thereof.

19. The illumination system of claim 1, wherein the object is at least one of a person, a textile, a living being, or combinations thereof.

20. The illumination system of claim 1, wherein the object is a textile.

* * * * *